US008610651B2

(12) United States Patent
Le Roy

(10) Patent No.: US 8,610,651 B2
(45) Date of Patent: Dec. 17, 2013

(54) DEVICE FOR DISPLAYING IMAGES ON AN ACTIVE MATRIX

(75) Inventor: Philippe Le Roy, Betton (FR)

(73) Assignee: Thomson Licensing, Boulogne-Billancourt (FR)

( * ) Notice: Subject to any disclaimer, the term of this patent is extended or adjusted under 35 U.S.C. 154(b) by 257 days.

(21) Appl. No.: 10/583,924

(22) PCT Filed: Dec. 21, 2004

(86) PCT No.: PCT/FR2004/003328

§ 371 (c)(1),
(2), (4) Date: Jun. 22, 2006

(87) PCT Pub. No.: WO2005/071649

PCT Pub. Date: Aug. 4, 2005

(65) Prior Publication Data

US 2008/0272993 A1 Nov. 6, 2008

(30) Foreign Application Priority Data

Dec. 23, 2003 (FR) ..... 03 15295

(51) Int. Cl.
*G09G 3/34* (2006.01)

(52) U.S. Cl.
USPC ..... 345/84; 345/204; 345/211; 345/55

(58) Field of Classification Search
USPC ..... 345/204–206, 39, 55, 76–86
See application file for complete search history.

(56) References Cited

U.S. PATENT DOCUMENTS

2002/0011172 A1 1/2002 Ito et al.
2002/0101172 A1* 8/2002 Bu ..... 315/169.3
2003/0146888 A1* 8/2003 Yamazaki et al. ..... 345/82

FOREIGN PATENT DOCUMENTS

EP 1221686 7/2002
JP 2002-91377 7/2002
JP 2002-278513 1/2003

OTHER PUBLICATIONS

Patent Abstracts of Japan, vol. 2002, No. 07, Jul. 3, 2002 & JP 2002-091377. (Hitachi Ltd.).
Patent Abstracts of Japan, vol. 2003, No. 01, Jan. 14, 2003 & JP 2002-278513 (Sharp Corp).
Search Report Dated May 6, 2005.

* cited by examiner

*Primary Examiner* — Christopher E Leiby
(74) *Attorney, Agent, or Firm* — Robert D. Shedd; Patricia A. Verlangieri

(57) ABSTRACT

The invention relates to an active-matrix display device which comprises:

an array of light emitters, each emitter being supplied by power supply means;

a current modulator having a trip-threshold voltage, said modulator being able to be addressed by applying a data setpoint to one of its terminals and a drain current being able to flow through said modulator in order to control said emitter; and trip-threshold voltage compensation means comprising a comparator for comparing the value of the drain current with the value of the data setpoint during a programming step.

The power supply means for the emitters are capable of supplying the emitters during the programming step.

13 Claims, 4 Drawing Sheets

$V_{select}$
t $V_{init}$
t

S
t

I
$I_d$
$I_{data}$
t

A
B
C
D

DEVICE FOR DISPLAYING IMAGES ON AN ACTIVE MATRIX

This application claims the benefit, under 35 U.S.C. §365 of International Application PCT/FR04/03328, filed Dec. 21, 2004, which was published in accordance with PCT Article 21(2) on Aug. 4, 2005 in French and which claims the benefit of French patent application No. 0315295, filed Dec. 23, 2003.

The present invention relates to an active-matrix image display device.

Flat displays are being increasingly used in all kinds of applications, such as in automobile display devices, in digital cameras or in mobile telephones. Displays in which the light emitters are formed from organic electroluminescent cells, such as OLED (organic light-emitting diode) displays, are known.

In particular, passive-matrix OLED-type displays are already widely available commercially. However, they consume a large amount of electrical energy and have a short life time.

Active-matrix OLED displays include built-in electronics and have many advantages, such as reduced power consumption, high resolution, compatibility with video rates, and a longer life time than passive-matrix OLED displays.

Conventionally, display devices comprise a display panel formed especially by an array of light emitters. Each light emitter is associated with a pixel or with a sub pixel of an image to be displayed and is addressed by an array of column electrodes and an array of row electrodes via an address circuit.

In particular, the address circuits comprise current modulators capable of controlling the current passing through the emitters and therefore the luminance of each sub pixel of the display panel.

In an active matrix, these modulators are thin-film transistors, or TFTs, fabricated in polycrystalline silicon using the LTPS (low-temperature polysilicon) technology. However, this technique introduces local spatial variations in the trip-threshold voltage of the thin-film transistors. These variations are due to the fact that the boundaries and the dimensions of the polysilicon grains cannot be controlled sufficiently during the phase of crystallizing amorphous silicon to polycrystalline silicon, called polysilicon. Thus the TFT transistors that make up a given display panel have different trip-threshold voltages.

Consequently, the TFT transistors supplied with the same supply voltage and driven by identical data voltages or currents generate currents of different intensity.

Now, as an emitter generally emits light with an intensity directly proportional to the current passing through it, the heterogeneity of the trip thresholds of polysilicon transistors leads to brightness non-uniformity of a display formed by a matrix of such transistors. This results in differences between the luminance levels and manifest visual discomfort for the user.

To compensate for the trip-threshold voltages of the TFT transistors of an active matrix, it is known, for example from US document U.S. Pat. No. 6,433,488, to use an emitter drive circuit that includes a comparator capable of comparing the drain current $I_d$ passing through the modulator with a reference current during a step of programming the drive circuit. However, this circuit requires the implantation of one switching unit per emitter in order to switch the supply source for the emitter between the programming step and an emission step of the emitter. This switching unit comprises two thin-film transistors and an inverting amplifier. This circuit is difficult to fabricate and is expensive.

Active-matrix display devices comprising OLED emitters, means for supplying the emitters, modulators and means for compensating for the trip-threshold voltages of the modulators are known, for example from document EP 1 381 019. The compensation means comprise means for comparing the drain current passing through a selected emitter with a display setpoint.

However, in these display devices, the emitters are not supplied by the same supply means both during the programming phases and the subsequent emission phases for image display, thereby requiring a specific array of electrodes for each supply mode.

A display device comprising OLED emitters, means for supplying the emitters, modulators and means for compensating for the trip-threshold voltages of the modulators are known for example from document JP-2002/278513. The emitters are supplied by the same supply means both during the programming phases and the subsequent emission phases for image display, but the threshold voltages are compensated for during a calibration phase prior to image display. The compensation means comprise means for measuring the drain current passing through a selected emitter and comparators for comparing this drain current with a calibration setpoint for this emitter. These compensation means therefore do not allow compensation of variations in threshold trip voltages that appear during the image display phase.

Active-matrix display devices comprising OLED emitters, modulators and means for compensating for the trip-threshold voltages of the modulators are known for example from the documents JP-2002/091377, US-2003/001832 and WO-2004/034364. The compensation means comprise means for measuring the drain current passing through a selected emitter and comparators for comparing this drain current with a display setpoint. However, the means for measuring the drain current are specific to each emitter of a column. For example, in document WO-2004/034364, they comprise a resistor, two electrodes and two switches for each emitter of a column. This architecture is consequently complex and expensive.

It is an object of the present invention to provide a less complex, and therefore less expensive, drive circuit.

For this purpose, the subject of the present invention is an active-matrix image display device comprising:

- several light emitters forming an array of emitters distributed in rows and columns;
- power supply means capable of supplying current simultaneously to all of the emitters of a column during an emission step and a step of programming the emitters;
- means for controlling the emission of the emitters comprising:
  - for each emitter of the array, a current modulator comprising a source electrode, a drain electrode and a gate electrode, a drain current being able to pass through said modulator in order to supply said emitter, for a voltage between the drain or the source and the gate equal to or greater than a trip-threshold voltage,
  - for each column of emitters, column address means capable of addressing in succession each emitter of said column of emitters by applying a value representative of a data setpoint to the gate electrode of the modulator associated with this emitter, in order to actuate it, during a programming step, for each row of emitters, row select means capable of selecting in succession the emitters of each row of emitters, during the programming step and for each modulator, storage means capable of storing electric charges at the gate electrode of the modulator; and trip-threshold voltage compensation means comprising comparators, the comparators being capable of comparing, during the step of programming a selected emitter, a value representative of the drain current supplying the selected emitter with the value representative of the data setpoint for controlling the quantity of charge stored in the storage means, characterized in that the compensation means comprise, for each column of emitters, a single unit for determining a representative value of the drain current supplying the selected emitter on the basis of a measurement of a representative value of the current for supplying all of the emitters of the column.

According to particular embodiments, the display device comprises one or more of the following features:

the power supply means for the emitters are connected directly to each modulator of the control means;

the power supply means for the emitters are connected directly to each emitter of a column;

the power supply means for the emitters comprise a voltage supply generator capable of supplying all of the emitters of a column and the compensation means are capable of compensating in succession the trip-threshold voltage of each modulator of all of the emitters of a column;

the compensation means further include:

a drive generator capable of generating a drive signal applied to the gate of said modulator and means for modulating the duration of said drive signal according to the value of the data setpoint and the value of the trip-threshold voltage;

the data setpoint is a data voltage and the comparators are capable of emitting a warning signal when the voltage representative of the intensity of the drain current is equal to a number of times said data voltage;

the means for modulating the duration of the drive signal comprise:

a switch connected in series with the drive generator and a control unit capable of switching said switch, on the one hand, when the data setpoint is received, and on the other hand, when the warning signal is received;

the drive signal generated by the drive generator is amplitude-modulated according to the value of the data setpoint;

the drive generator is a current generator and the modulator is capable of being current-controlled;

the drive generator is a ramp voltage generator and the modulator is capable of being voltage-controlled;

the compensation means further include a unit for measuring the intensity of a current, capable of measuring the intensity of the drain current passing through a selected emitter during the programming step;

the supply means comprise a line to which the measurement unit is directly connected; and the storage means comprise at least one storage capacitor connected to the gate and to the source of the modulator and the compensation means further include reset means capable of applying a voltage pulse to said capacitor in order to discharge it.

The invention will be more clearly understood on reading the description that follows, given by way of non-limiting example and with reference to the appended figures in which.

Figures 3A, 3B, 3C, 3D:
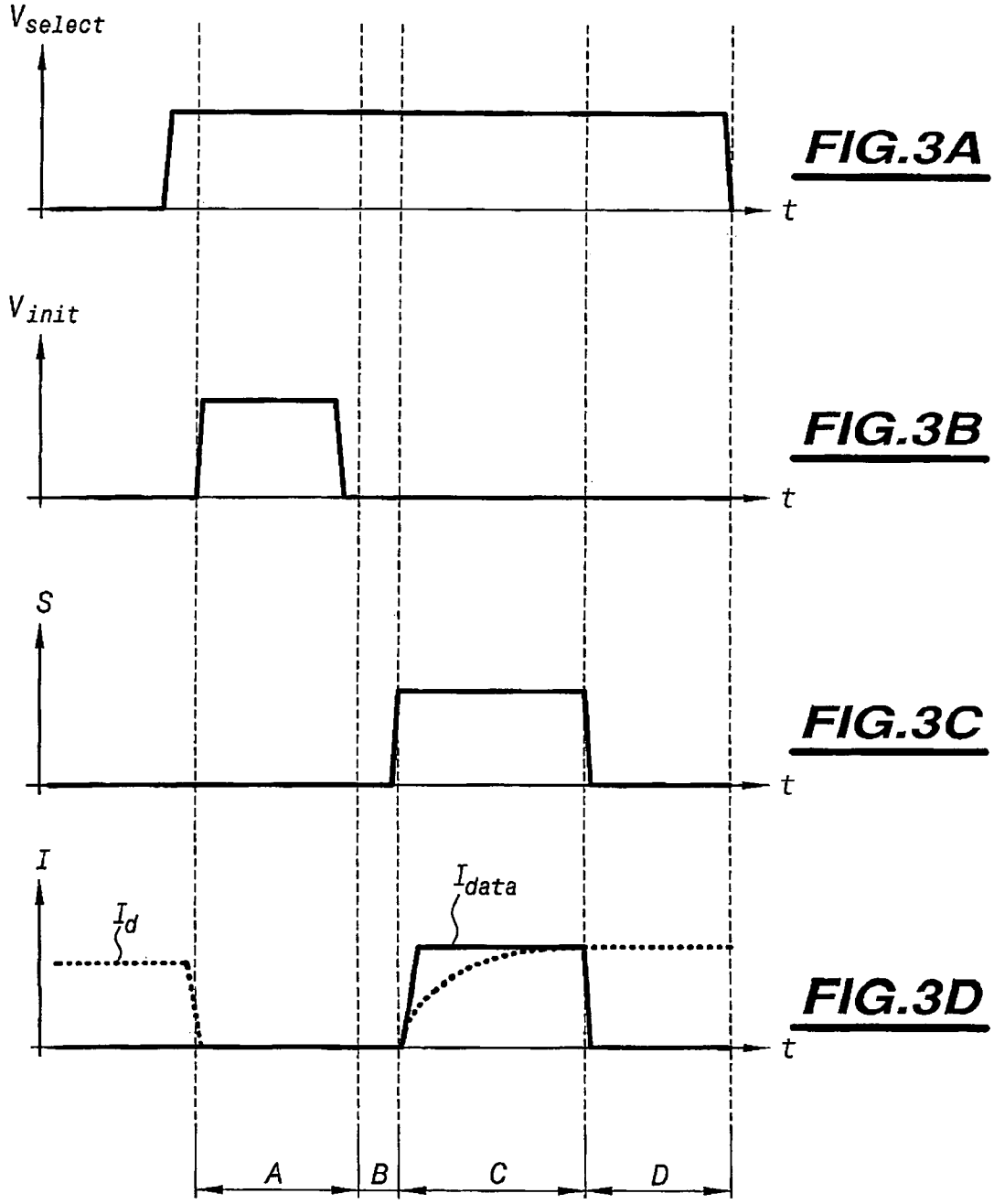
Figure 4:
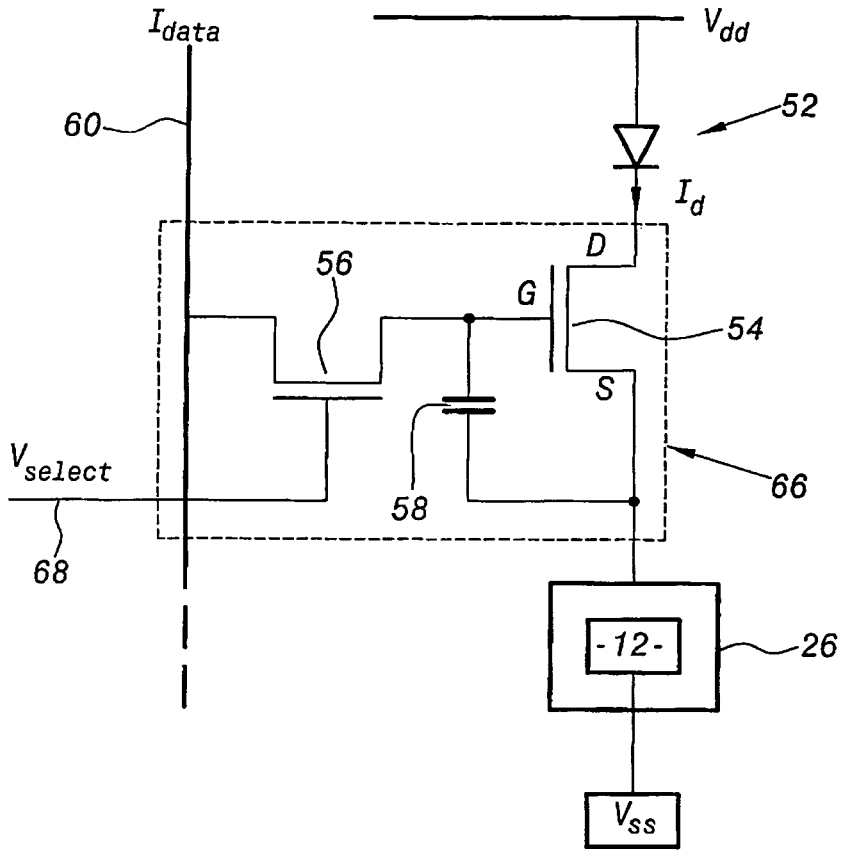

FIGS. 3A to 3D are graphs showing the variation with time of various voltages and currents during the procedure performed by the device according to the invention, in particular FIG. 3A is a graph showing the select voltage applied to the select electrode, FIG. 3B is a graph showing the voltage applied to the address electrode by the reset means, FIG. 3C is a graph showing the warning signal generated by the comparator and FIG. 3D is a graph showing the variation in the drain current and in the drive current; and FIG. 4 is a block diagram of an address circuit according to one embodiment of the invention.

Figure 1:
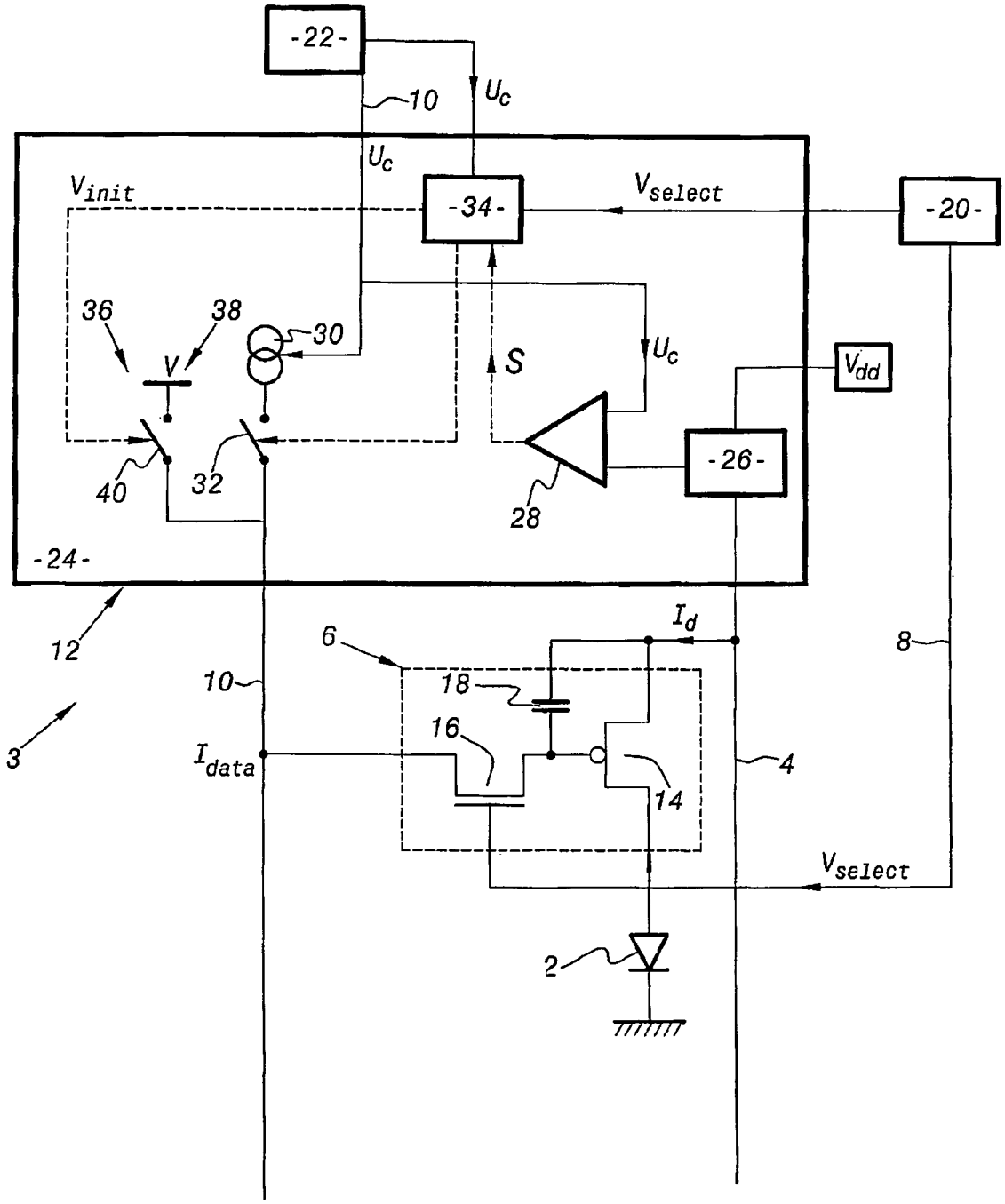
FIG. 1 is a block diagram of a drive/supply circuit for an emitter according to the invention.

FIG. 1 shows an active-matrix display device according to the invention. Such a device comprises a plurality of light emitters 2 forming an array of rows and columns, power supply means $V_{dd}$ for the emitters 2, and emission control means 3 for the emitters. However, for the sake of simplification, a single emitter and a single supply means have been shown in FIG. 1.

The emitters 2 of the display panel are organic light-emitting diodes. They comprise an anode and a cathode. Each diode is associated with one pixel when the display is a monochrome display or with one sub pixel when the display panel is a polychrome display. They emit light with an intensity directly proportional to the current that passes through them.

The power supply means $V_{dd}$ for the emitters 2 comprise one DC voltage generator per column of emitters 2. This generator $V_{dd}$ supplies a line 4 to which all of the emitters 2 of this column are connected.

The drive means 3 for the display device comprise an address circuit 6 for each emitter, an array of row select 8 and column address 10 electrodes and compensation means 12 for compensating for the trip threshold of the modulators.

An address circuit 6 is connected to each emitter 2 of the display panel. The address circuit shown in FIG. 1 is a circuit of conventional structure. In this type of circuit, the anode of the emitter forms the interface with the active matrix, and the cathode of the emitter is connected to a ground electrode or to a negative voltage.

The address circuit 6 comprises a current modulator 14, a switch 16 and a storage capacitor 18.

The current modulator 14 is a transistor based on a technology using polycrystalline silicon (poly-Si) or amorphous silicon (a-Si) deposited as thin films on a glass substrate. Such components comprise three electrodes, namely a drain electrode, a source electrode, the modulated current flowing between these two electrodes, and a gate electrode to which a data drive current $I_{data}$ is applied.

The thin-film transistors are of the n-type or p-type. The modulator 14 shown in FIG. 1 is of the p-type. Its source is connected directly to the supply electrode $V_{dd}$ and its drain is connected directly to the anode of the emitter 2 so that, in operation, the modulated electric current flows between the source and the drain. Alternatively, when the modulator 14 is of the n-type, the drain is connected to the supply electrode $V_{dd}$ and the modulated electric current then flows between the drain and the source.

The power supply generator $V_{dd}$ is connected directly to all of the drive modulators 14 for the emitters of a column, so that it is always capable of supplying a selected and addressed emitter 2, irrespective of the step in the image frame emission process. Thus, as soon as a modulator 14 of the column is turned on, by applying an address-and-select voltage, the corresponding emitter is supplied by just the generator $V_{dd}$.

The switch 16 is also a transistor based on the technology using polycrystalline silicon (poly-Si) or amorphous silicon (a-Si) deposited as thin films. One of its electrodes (the drain or source) is connected to the address electrode 10 and the other electrode (the drain or source) is connected to the gate of the modulator 14. Its gate is connected to the row select electrode 8.

The storage capacitor 18 is placed between the gate and the source of the modulator 14 in order to maintain the brightness of the emitter 2 over the duration of a frame image. This capacitor is designed to keep the voltage on the gate of the modulator 14 substantially constant over a time interval corresponding to the duration of one frame.

The array of select electrodes 8 and address electrodes 10 is used to select and address a specific emitter from among the set of emitters of the display panel.

Each select electrode 8 is connected to the gate of the switches 16 of one row and is capable of transmitting a select voltage $V_{select}$ to all of the emitters 2 of this row. The select voltage $V_{select}$ is a logic data signal for selecting the emitters.

Each address electrode 10 is connected to the source or to the drain of the switches 16 of a column and is capable of addressing the gate of the modulator 14 of all of the address circuits 6 of this column with a data drive current $I_{data}$ according to a data setpoint $U_c$. In the exemplary embodiment of the invention shown in FIG. 1, the current passing through the emitter is proportional to the amplitude of the current $I_{data}$ applied to the electrode 10.

The select electrodes 8 and address electrodes 10 are each controlled by a corresponding driver 20, 22 for applying select voltages $V_{select}$ and data setpoints $U_c$ to the emitters. Thus, by selecting a single row electrode 8 of the display and only activating the driver 20 corresponding to this row and applying a data setpoint $U_c$ to a column electrode 10 of this display, suitable for applying a drive current $I_{data}$ to the modulator 14, a single emitter at the intersection between the electrode of this row 8 and the electrode 10 of this column is capable of emitting light.

The trip threshold compensation means 12 are capable of compensating for the trip-threshold voltages $V_{th}$ of all of the modulators 14 addressed by the address electrode 10 of this column.

They comprise one external controller 24 per column of emitters. This controller comprises a measurement unit 26, a comparator 28, a drive generator 30, a switch 32, a control unit 34 and means 36 for resetting the address circuits 6 of this column.

The measurement unit 26 is connected to the power supply electrode 4 of all of the emitters of a column. The measurement unit 26 is capable of measuring a value representative of the drain current $I_d$ of a modulator 14 selected by the select electrode 8, to the gate of which modulator a drive current $I_{data}$ is applied.

More precisely, the role of the unit 26 is to extract, from the sum of the currents measured in the line 4, only the current of the modulator 14 during its programming step. One embodiment of the measurement unit 26 will be described below in conjunction with FIG. 2.

The comparator 28 has two input terminals designed to receive the data setpoint $U_c$ addressed by the driver 22 and a representative value of the drain current $I_d$ measured by the measurement unit 26.

In the embodiment of the invention shown in FIG. 1, the data setpoint $U_c$ is a data voltage. The comparator 28 is designed to compare the amplitude of the voltage representative of the drain current $I_d$ with the amplitude of the data voltage $U_c$ during what is called step C for programming the address circuit 6.

In addition, the comparator 28 has an output terminal capable of transmitting a warning signal S when the amplitude of the voltage representative of the intensity of the drain current $I_d$ and the amplitude of the data voltage $U_c$ are related through a predetermined coefficient of proportionality k. The warning signal S is a logic signal sent to the control unit 34.

As a variant, the data setpoint is a digital data signal or a data current.

The drive generator 30 is a DC generator designed to deliver a drive current $I_{data}$ that depends on the data setpoint $U_c$ applied to this generator. It is connected in series to the address electrode 10. It is capable of receiving the data voltage $U_c$ addressed by the column driver 22 and of generating a drive current $I_{data}$, the amplitude of which is modulated according to the amplitude of the data voltage $U_c$.

The switch 32 is connected in series with the output of the drive generator 30. It is capable of switching between a closed position, in which the drive current $I_{data}$ supplies the address electrode 10 of all of the address circuits 6 of the column, and an open position, in which the address circuits 6 are not addressed.

The control unit 34 is connected to the driver 22, to the output of the comparator 28 and to the switch 32 in order to receive the data voltage $U_c$ and the warning signal S and to cause the switch 32 to switch. The control unit 34 is capable of closing the switch 32 upon receiving the data voltage $U_c$ and opening the switch upon receiving the warning signal S. Thus, the duration of the generated drive current $I_{data}$ is modulated according to the trip-threshold voltage $V_{th}$ specific to each modulator 14, as will be explained below.

The means 36 for resetting the address circuits 6 are connected in parallel to the generator 30 so that the image of one frame is not influenced by the image of the next frame. These means are capable of transmitting a square-wave voltage for discharging the storage capacitor 18 and a parasitic capacitor induced by the display panel. They comprise a DC generator 38 and a switch 40. The switch 40 is connected to the control unit 34. The control unit 34 is connected to the driver 20 for closing the switch 40 upon receiving the select voltage $V_{select}$.

Alternatively, the address circuit 6 includes a switch for shunting the storage capacitor 18.

Figure 2:
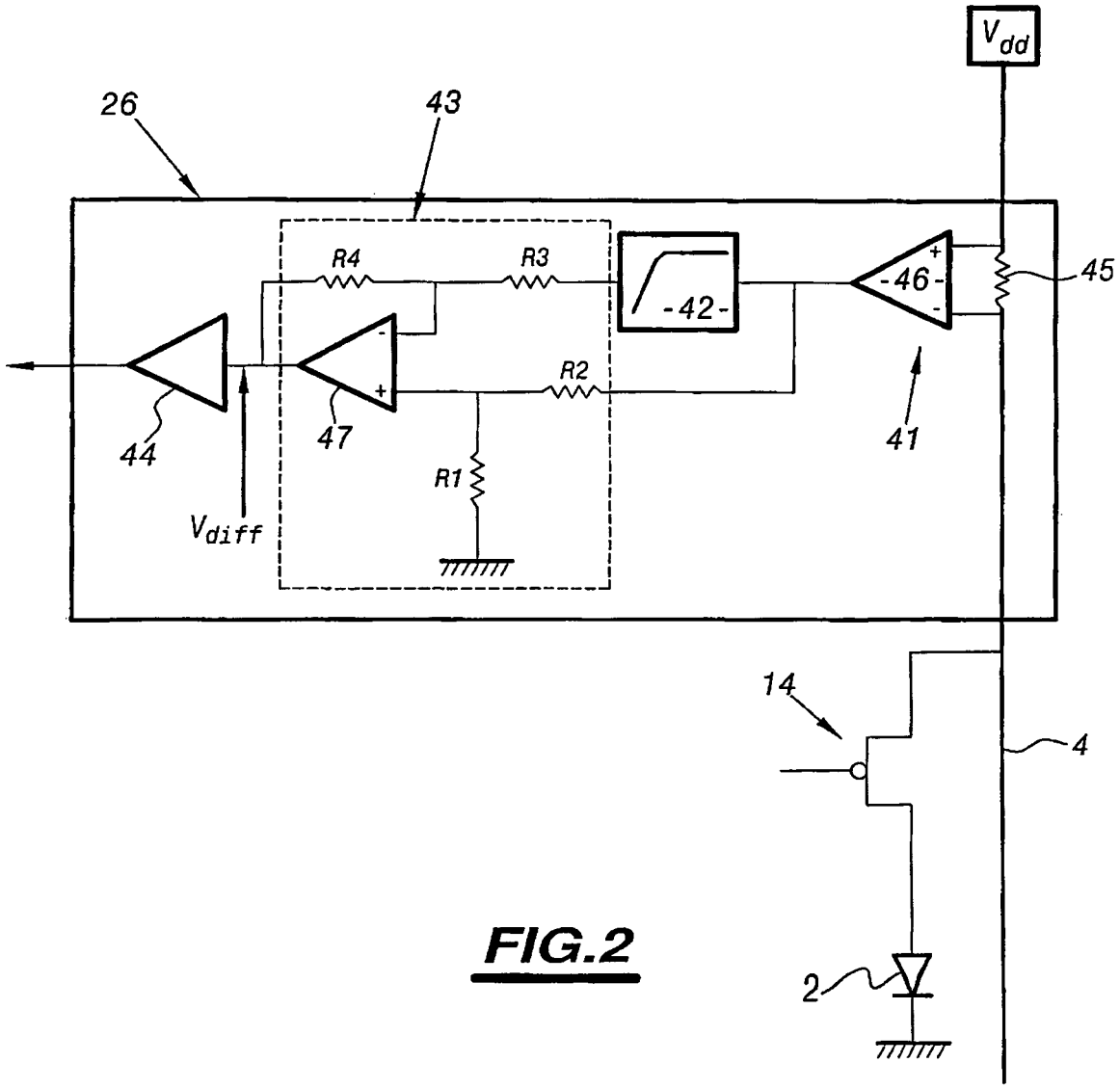
FIG. 2 is a block diagram of an exemplary embodiment of a current measurement unit according to the invention.

FIG. 2 shows one embodiment of a unit 26 for measuring a value representative of the drain current $I_d$ passing through the modulator 14 of the drive circuit for which the programming step starts.

Such a measurement unit 26 is connected to the supply line 4 for the emitters 2 of a column. It comprises a unit 41 for determining the drain current $I_d$, a low-pass filter 42, a differential unit 43 and an amplifier 44.

The determination unit 41 comprises a resistor 45, for example a 1 to 10 kilo ohm resistor, connected in series with the supply line 4 for the emitters, and a precision operational amplifier 46, the terminals of which are connected to the supply line 4 on either side of the resistor 45. The output of the amplifier 46 is connected, on the one hand, to the low-pass filter 42, which is itself connected to a negative terminal of an amplifier 47 of the differential unit 43, and, on the other hand, to a positive terminal of this amplifier 47.

The differential unit 43 comprises an amplifier 47 in a differential configuration and a network of four resistors of the same value. A first resistor R1 is connected between the positive input of the amplifier 47 and a ground electrode. A second resistor R2 is connected between the positive input of the amplifier 47 and the output of the amplifier 46. A third resistor R3 is connected between the negative input of the amplifier 47 and the output of the low-pass filter 42. Finally, a fourth resistor R4 is connected between the negative input of the amplifier 47 and its output terminal. In addition, the output of the differential unit 43 is connected to a high-gain amplifier 44.

The determination unit 41 is capable of measuring the total current supplying all of the emitters of a column, including the drain current passing through the modulator 14 during the programming thereof. This drain current therefore appears at the terminals of the resistor 45 in the form of a current pulse. The output voltage of the determination unit 41 is proportional to the total current passing along the line 4. This voltage is applied to the terminals of the low-pass, filter 42, which eliminates the high-frequency component therefrom. This high-frequency component corresponds to the current pulse generated by the modulator 14, which is supplied via the line 4 and is undergoing a programming step.

The amplifier 47 of the differential unit receives, on its negative input, a voltage proportional to the total supply current of the line 4, with the exception of the component corresponding to the drain current passing through the modulator 14, and, on its positive input, a voltage proportional to the total current on the line 4. Since the resistors R1, R2, R3 and R4 have the same value, the output voltage $V_{diff}$ of the differential unit 43 is equal to the resistance of the resistor 45 multiplied by the drain current of the modulator 14 which is undergoing a programming step. This voltage is amplified by the amplifier 44 and then compared with the data voltage $U_c$ in the comparator 28, as was explained above.

In an alternative embodiment of the invention, the image display device is a voltage control circuit for the modulators. The DC generator 30 is then replaced with a voltage supply generator and preferably with a ramp voltage generator.

In this case, as in the case of a current control circuit for the modulators as described above, the amplitude of the ramp voltage is modulated according to the amplitude of the data setpoint, transmitted by the column driver 22. The duration of the ramp voltage addressed to the address circuits 6 is also modulated according to the trip-threshold voltage $V_{th}$, by the comparator 28 and the control unit 34.

The four graphs of FIGS. 3A to 3D show the address steps for an emitter when the latter is produced by the display device according to the invention.

These steps comprise a step A of resetting an address circuit 6, an intermediate step B, a step C of programming an address circuit and a step D of emitting light proportional to the preprogrammed drive current $I_{data}$.

During the reset step A, the row driver 20 applies a voltage $V_{select}$ to the electrode 8 of the row selected. This voltage is applied to the gate of the switches 16, said gate being connected to the row electrode 8. At the same time, the control unit 34 of the external controller 24 of a column closes the switch 40, and a voltage $V_{reset}$ generated by the generator 38 is applied to the address electrode 10 of this column. The voltage $V_{reset}$ is applied to one terminal of the storage capacitor 18 in order to discharge it, the switch 16 being closed.

The intermediate step B is of short duration and has the sole function of creating a dead time in order to separate the reset step from the programming step, so as to avoid any short circuit.

During a programming step C, the column driver 22 transmits a data voltage $U_c$, the control unit 34 closes the switch 32, and the drive generator 30 generates a drive current $I_{data}$. Since the switch 16 is closed, the current $I_{data}$ generates a potential difference between the gate and the source of the modulator 14.

When this potential difference is greater than the trip-threshold voltage $V_{th}$ of the modulator 14, a drain current $I_d$ flows between the drain and the source of the modulator.

The intensity of this drain current $I_d$, which corresponds to part of the current flowing in the line 4, is measured by the measurement unit 26 and a voltage representative of this drain current is compared with the data voltage $U_c$ addressed by the driver 22. As a variant, when the data setpoint is a current, the amplitude of this current is compared with the amplitude of the drain current.

The drain current generated passes through the emitter 2, which illuminates. The generator $V_{dd}$ supplies the emitter 2 with power.

The comparator 28 compares the data voltage $U_c$ with the voltage representative of the amplitude of the drain current $I_d$. As may be seen in FIG. 3D, the amplitude of the drain current increases quadratically with the voltage between the gate and the source of the modulator. Little by little, the drive current $I_{data}$ generated by the generator 30 causes charges to be stored in the storage capacitor 18 connected to the gate of the modulator 14. This charge storage causes the voltage $V_{gs}$ between the gate and the source of the modulator 14 to increase, and consequently the drain current $I_d$ to increase progressively.

When the voltage representative of the drain current $I_d$ is proportional to the data voltage $U_c$, more precisely when $I_d=I_{data}/k$, where $k>1$, the comparator 28 sends a warning signal S to the control unit 34 which, in return, closes the switch 32. The programming step is completed.

The duration of the programming step can vary and depends on the trip threshold of each current modulator of the column. The address signal for each emitter is therefore modulated in terms of duration according to the trip-threshold voltages.

In practise, the current $I_{data}$ is of the order of a few microamps so that the storage capacitor 18 and the parasitic capacitances generated by the structure of the display panel are rapidly charged. Since the current $I_{data}$ is about four times greater than the drain current $I_d$, the programming time is short, of the order of a few microseconds (μs).

During the programming step C, the storage capacitor 18 was sufficiently charged for the emitter 2, after being addressed, to continue to emit over the duration of the image frame, while still being supplied from the generator $V_{dd}$.

The address time for the drive current $I_{data}$, corresponding to the time during which the switch 32 is closed, depends both on the trip-threshold voltage $V_{th}$ of the selected modulator 14 and on the value of the setpoint $I_{data}$. Thus, the trip threshold compensation means 12 are capable of modulating the duration of the drive signal $I_{data}$ in turn for each modulator of the column of emitters.

Step D starts at the end of the programming step and is complete by the end of the selection of the row 8. During this step D, the emitter 2 is still selected, but its programming is complete—it continues to emit according to this programming thanks to the voltage stored across the terminals of the capacitor 28. During the rest of the image frame and before another programming step corresponding to a new frame, the drain current $I_d$ continues to flow through the modulator 14 and the emitter 2 until the voltage across the terminals of the storage capacitor 18 is discharged during a new step A of resetting this address circuit.

As soon as the step C of programming an address circuit 6 associated with a first emitter 2 has been completed, the drivers 20, 22 and the compensation means 12 are used for programming another address circuit associated with a second emitter of the same column. During step A of resetting the address circuit associated with the second emitter, the first emitter 2 continues to emit. The generator $V_{dd}$, which supplied power to the emitter 2 during programming step C, continues to supply it as long as the gate voltage of the modulator 14 is above its trip-threshold voltage.

FIG. 4 shows an alternative embodiment of the invention in which the drive means 3 are identical to those shown in FIG. 1. However, the address circuit 6 driving a light emitter 2 of conventional structure is replaced with an address circuit 66 driving a light emitter of inverted structure.

In this type of circuit, the cathode of the emitters 52 forms the interface with the active matrix, and the anode of the emitters 52 is connected to the power supply generator $V_{dd}$. The source of the modulator 54 is connected to ground or to a negative voltage generator. The cathode of the emitter 52 is connected to the drain of the modulator 54. The storage capacitor 58 is connected between the gate and the source of the modulator 54. A switch 56 is addressed with current $I_{data}$ via an address electrode 60 and is selected via a select electrode 68.

The power supply generator $V_{dd}$ is connected directly to all of the emitters 52 of all of the columns without interposition of a switching unit. Consequently, this generator $V_{dd}$ supplies power to all the emitters 52 during programming step C and during step D over the entire duration of the image frame. Consequently, it is the power supply means $V_{ss}$ that are connected separately to the compensation means 12.

Since the supply means are connected directly to each modulator or connected directly to each emitter of a column, the circuit diagram of the display device is simplified and technically easier to produce.

As each power supply generator $V_{ss}$ is capable of supplying all of the emitters 2 of a column and since each address electrode 60 is also capable of addressing all of the emitters 2 of a column, the compensation means 12 are capable of compensating in succession the trip-threshold voltage $V_{th}$ of all of the modulators 14 of a column.

Moreover, since the compensation means 12 determine the duration of the signal before each frame, the variations in the trip threshold that are due to aging of the modulators are automatically compensated.

Advantageously, no switching unit is interposed between the generator $V_{dd}$ or $V_{ss}$ and the modulator 14 or the emitter 52 for switching between two supply sources for the emitter during the programming procedure and during emission by the emitter. Consequently, the useful light-emitting area of the pixels is increased.

Since the address circuit is addressed by a current or a voltage, which is analog and not digital, the control means are simplified and their implementation is facilitated.

Advantageously, the compensation means for all of the columns compensate for the dispersions in the trip-threshold voltages of the modulators of drivers for an active-matrix display.

Advantageously, the unit 26 for measuring the current flowing through a modulator during a programming step C makes it possible to dispense with a switching unit associated with each emitter.

Advantageously, since the intensity of the drive current $I_{data}$ is high, the parasitic capacitors generated by the address column of the display panel are rapidly charged. Consequently, the display device is addressed instantly.

The invention claimed is:

1. An active-matrix image display device comprising:

several light emitters forming an array of emitters distributed in rows and columns;

means for controlling the emission of the emitters comprising:

for each emitter of the array, a current modulator comprising a source electrode, a drain electrode and a gate electrode, a drain current being able to pass through said modulator in order to supply said emitter, for a voltage between the drain or the source and the gate equal to or greater than a trip-threshold voltage, for each modulator, storage means capable of storing electric charges at the gate electrode of the modulator, for each row of emitters, row select means capable of selecting in succession the emitters of each row of emitters, for programming these emitters, and for each column of emitters, column address means capable of addressing in succession each selected emitter of said column of emitters by applying, during the programming step of this selected emitter, a value representative of a data setpoint to the gate electrode of the modulator associated with this selected emitter, in order to actuate it, a DC voltage generator for supplying current simultaneously to each of the emitters of each column through a same and single supply line during both emission steps and programming steps of the emitters of said column, as soon as the modulator of each column is turned on; and trip-threshold voltage compensation means comprising comparators, the comparators being capable of comparing, during the step of programming a selected emitter, a value representative of the drain current supplying the selected emitter with the value representative of the data setpoint for controlling the quantity of charge stored in the storage means, wherein the compensation means comprise, for each column of emitters, one single separate unit for determining a representative value of the drain current supplying the selected emitter of this column by measuring the total current supplying all of the emitters of this column, and for turning on the emitters already during the programming step.

2. The image display device as claimed in claim 1, wherein the current supply means for the emitters are connected directly to each modulator of the control means.

3. The image display device as claimed in claim 1, wherein the current supply means for the emitters are connected directly to each emitter of a column through one single current supply line.

4. The image display device as claimed in claim 1, wherein the current supply means for the emitters comprise a voltage supply generator capable of supplying all of the emitters of a column through one single current supply line and wherein the compensation means are capable of compensating in succession the trip-threshold voltage of each modulator of all of the emitters of this column.

5. The image display device as claimed in claim 1, wherein the compensation means further include:

a drive generator capable of generating a drive signal applied to the gate of said modulator; and means for modulating the duration of said drive signal according to the value of the data setpoint and the value of the trip-threshold voltage.

6. The image display device as claimed in claim 5, wherein the data setpoint is a data voltage and wherein the comparators are capable of emitting a warning signal when the voltage representative of the intensity of the drain current is equal to a number of times said data voltage.

7. The image display device as claimed in claim 6, wherein the means for modulating the duration of the drive signal comprise:

a switch connected in series with the drive generator; and a control unit capable of switching said switch, on the one hand, when the data setpoint is received, and on the other hand, when the warning signal is received.

8. The image display device as claimed in claim 5, wherein the drive signal generated by the drive generator is amplitude-modulated according to the value of the data setpoint.

9. The image display device as claimed in claim 5, wherein the drive generator is a current generator and the modulator is capable of being current-controlled.

10. The image display device as claimed in claim 5, wherein the drive generator is a ramp voltage generator and the modulator is capable of being voltage-controlled.

11. The image display device as claimed in claim 1, wherein the compensation means further include a unit for measuring the intensity of a current, capable of measuring the intensity of the drain current passing through a selected emitter during the programming step.

12. The image display device as claimed in claim 11, wherein the supply means comprise a line to which the measurement unit is directly connected.

13. The image display device as claimed in claim 1, wherein the storage means comprise at least one storage capacitor connected to the gate and to the source of the modulator and wherein the compensation means further include reset means capable of applying a voltage pulse to said capacitor in order to discharge it.

* * * * *